US007195678B1

(12) United States Patent
Wall

(10) Patent No.: US 7,195,678 B1
(45) Date of Patent: Mar. 27, 2007

(54) METHOD OF INSTALLING AN INSPECTION PORT ONTO ASBESTOS INSULATED PIPE AND EQUIPMENT

(76) Inventor: Howard Wall, 4450 Sherwood, Suite 2, Houston, TX (US) 77692

( * ) Notice: Subject to any disclaimer, the term of this patent is extended or adjusted under 35 U.S.C. 154(b) by 0 days.

(21) Appl. No.: 11/125,538

(22) Filed: May 11, 2005

Related U.S. Application Data

(63) Continuation-in-part of application No. 10/873,948, filed on Jun. 21, 2004, now abandoned.

(51) Int. Cl.
*B08B 5/00* (2006.01)
*B08B 7/00* (2006.01)

(52) U.S. Cl. ..... 134/21; 134/22.1; 134/22.11; 134/42; 134/152; 134/166 R; 134/170

(58) Field of Classification Search ..... 134/22.1, 134/22.11, 22.12, 42, 152, 166 R, 170, 21
See application file for complete search history.

(56) References Cited

U.S. PATENT DOCUMENTS 3,936,217 A * 2/1976 Travaglini et al. ..... 415/118
5,096,474 A * 3/1992 Miller et al. ..... 96/403
5,147,242 A * 9/1992 Lowe, Jr. ..... 454/63
5,632,846 A * 5/1997 Ross ..... 156/308.4
5,759,333 A 6/1998 Ross
5,785,396 A 7/1998 Israel
5,890,781 A 4/1999 Ryder
6,149,252 A 11/2000 Browning
6,428,122 B1 8/2002 Henry et al.
2002/0043273 A1* 4/2002 Chau ..... 134/18
2003/0090174 A1* 5/2003 Ryder ..... 312/1

* cited by examiner

*Primary Examiner*—Zeinab El-Arini
(74) *Attorney, Agent, or Firm*—Egbert Law Offices

(57) ABSTRACT

A method of installing an inspection port on a pipe having asbestos insulation extending therearound in which the method has the steps of positioning the inspection port within a glove bag, affixing an opening of the glove bag onto a surface of the pipe, removing a section of asbestos insulation from the pipe, installing the inspection port onto the pipe within an area of the removed section, and removing the glove bag from the surface of the pipe. An air flow through the bag removes heat from the interior of the glove bag. The interior of the glove bag is maintained at a pressure below ambient.

9 Claims, 4 Drawing Sheets

METHOD OF INSTALLING AN INSPECTION PORT ONTO ASBESTOS INSULATED PIPE AND EQUIPMENT

RELATED U.S. APPLICATIONS

The present application is a continuation-in-part of U.S. patent application Ser. No. 10/873,948, filed on Jun. 21, 2004, and entitled "Glove Bag Adapted for Use on High Temperature Piping and Method of Installing Inspection Port on Asbestos Insulated Pipe", now abandoned.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to methods for asbestos removal. More particularly, the present invention relates to methods for the installing of an inspection port onto insulated piping. More particularly, the present invention relates to a method of installing inspection ports on asbestos-insulated piping in which glove bags are used for the containment of the removed asbestos material.

BACKGROUND OF THE INVENTION

In the past, asbestos containing materials have been used to insulate pipes and valves in chemical processing plants, commercial and residential buildings, and in other installations requiring insulation and fire resistant coverings. It has now been documented that exposure to asbestos may lead to cancer. Cancer-related maladies linked to asbestos are generally classified into five different categories, including asbestosis, a type of pulmonary disease caused by inhalation of asbestos-containing dust; pleural disease, which relates to changes in the pleura (the membranes enveloping the lungs and pleural cavity) caused by inhalation of the asbestos fibers; lung cancer; mesothelioma, a form of cancer of the pleural and peritoneal cavities; and other cancers such as laryngeal cancer and cancer of the gastrointestinal tract. Since the discovery of the cancer-causing propensities of asbestos-containing materials, efforts have been made to eliminate sources of asbestos fiber pollution of ambient air.

Asbestos, a fibrous form of magnesium and calcium silicate ore, is a friable material which may release microscopic fibers into the air. This presents a health hazard to workers responsible for removing asbestos-containing insulation materials. Consequently, elaborate provisions and regulations have been enacted to control the removal of these materials to minimize risk to workers.

The use of protective bag assemblies for isolating asbestos-coated conduits and/or protective clothing, including face masks to prevent inhalation of air-borne fibers, have become mandatory accessories for workers involved in removing asbestos-containing insulation.

In order to comply with the established regulations, assemblies have been devised to prevent the propagation of these contaminants into the atmosphere. In this connection, numerous waste removal systems have been designed utilizing a glove bag concept. One such glove bag removal system includes a detachable bag which sealingly encompasses a section of a pipe to be cleaned. A pair of specially shaped flaps are secured to a longitudinal axis of the pipe to form a circumscribing sleeve portion about the pipe. The bag also includes an internal tool pouch and inwardly extending armholes to permit a user to strip the fibrous material from the pipe while remaining isolated from the asbestos-containing materials. A lower portion of the bag collects the removed contaminant material in a separate collection compartment, and the collection compartment is then sealed and removed from a reusable upper portion of the bag.

In order to prevent escape of particles from a glove bag, a more recent improved glove bag includes an inlet for a vacuum probe which is inserted into the bag to maintain the interior of the bag at a negative pressure during removal of the waste material. The negative pressure gradient ensures that the airborne contaminants are captured and removed by the vacuum probe. Such glove bags also typically include one or more openings for water spray lines or water nozzles as an extra safety precaution for making the material less friable by wetting it down.

There are various problems associated with the use of glove bags in association with high temperature asbestos-insulated piping. Most importantly, the glove bags cannot be effectively used on pipes that have a temperature in excess of 150° F. In certain circumstances, the outer asbestos insulation covering (lagging) of the high temperature piping will have hot spots thereon (caused by fractured insulation) which will tend to melt the glove bag and impair the integrity of the glove bag. In other circumstances, the temperature of the outer asbestos insulation covering (lagging) of the pipe will prevent the adhesives associated with the glove bag from effectively adhering to the surface of the high-temperature piping. In all circumstances, the high temperature (up to 1000° F. for steam lines) will melt the glove bag once the insulation is removed and the surface of the pipe is exposed for the installation of the inspection port. As such, a need has developed in which glove bags can be used in association with high temperature piping for the removal of asbestos therefrom.

Additionally, in the past, asbestos removal from piping has involved the entire removal of the asbestos from the surface of the pipe. In these circumstances, the removal of asbestos is a very expensive and time consuming procedure. In certain circumstances, the process associated with such piping must be shut down during the asbestos removal. Often, these complete asbestos removal projects are carried out even though only small inspection ports are required to satisfy the needs of regulators. The entire removal insulation of asbestos from the surface of a pipe is time consuming, expensive and requires a great deal of personnel.

It is often desirable to install inspection ports on insulated piping. In many process industries, a large variety of pipes extend throughout the interior of the industry. Ultimately, the material associated with each of the pipes needs to be identified, monitored and maintained. In other circumstances, ultrasonic sensors must be installed in certain areas along the pipe so as to monitor the condition of the piping and possibly monitor the flow of materials within the piping. Still, in other circumstances, positive material identification is required for the various pipes which run throughout a particular process industry. Whenever positive material identification is required, a portion of the insulation of the piping must be removed so as to allow access to the actual material of the piping. The piping should be inspected for the quality of the material used for the pipe and also the condition of the material. Under past regulations, it is necessary to remove all of the asbestos insulation from around the piping in order to carry out positive material identification. Since the procedure is extremely expensive, various delays have occurred in complying with environmental regulations associated with such positive material identifications and associated with such asbestos removal. As such, a need has developed for the ability to install inspection ports without the need for shutting the process or without the need for removing the entirety of the asbestos insulation extending around the piping.

In the past, various patents have issued relating to glove bags and asbestos removing activities.

U.S. Pat. No. 5,147,242, issued on Sep. 15, 1992 to R. E. Lowe, Jr., shows a hazardous waste removal that has a generally rectangular flexible bag having a front panel and a back panel joined at a lower portion of the bag to form a collection chamber. The bag is sealed such that it is impermeable to dust and other particulate matter. The assembly also includes at least one glove sleeve fashioned through the front panel of the bag to permit an operator to remove asbestos from a segment of the enclosed conduit while maintaining subatmospheric air pressure within the bag. A replacement air intake inlet valve is positioned on the front or back panel to permit the ingress of ambient air into the bag while concomitantly preventing egress of air or particulate contents out of the bag.

U.S. Pat. No. 5,632,846, issued on May 27, 1997 to K. D. Ross, teaches a method of producing safety glove bags. Each of these bags has a sheet of flexible material having a centrally located opening and a lower debris collection and disposal bag that depends from the upper work section about the opening. Upon wrapping and securing the upper work section about a pipe with opposite ends thereof drawn upwardly thereto aside the opening, the work section is configured into a shape of a funnel for funneling debris worked from the pipe down into the collection and disposal bag.

U.S. Pat. No. 5,759,333, issued on Jun. 2, 1998 to J. D. Ross, shows another variation of U.S. Pat. No. 5,632,846 in which an elongated upper work section has a plurality of in-line lower debris collection and disposal bags depending therefrom. The upper work section has a bottom formed with a plurality of in-line chutes that extend between adjacent bags.

U.S. Pat. No. 5,785,396, issued on Jul. 28, 1998 to H. C. Israel, shows a glove bag for use in removing hazardous material from pipes. This glove bag includes a double-piece spreadable bag with a center portion that fits around the structure which is covered by asbestos. Flaps, glue and tape are used to seal the bag around the structure. Provision is made for the introduction of a wand for spraying the material with water.

U.S. Pat. No. 5,890,781, issued on Apr. 6, 1999 to M. Ryder, teaches a glove box which has a rigid frame. The frame has a first hollow face defining a drum-receiving portion that is tubular in shape and a second face that defines an outlet which is also tubular in shape. The remaining four faces of the frame are open and a flexible glove bag is shaped to fit over the frame covering the open faces and to be sealingly attached to the frame.

U.S. Pat. No. 6,149,252, issued on Nov. 21, 2000 to T. D. Browning, describes a glove box for cutting a hole in a ceiling. The glove box is a transparent container having a central aperture in the bottom. The aperture includes an inwardly extending ring having an outwardly extending flange for attaching a glove. The glove box is held by the user during use or may be supported on top of a telescoping pole.

U.S. Pat. No. 6,428,122, issued on Aug. 6, 2002 to Henry et al., describes a portable containment system that has a glovebox apparatus. The glovebox apparatus includes a first module for releasably covering a first sidewall opening. The glovebox also has a second modules for releasably covering a second sidewall opening.

U.S. Patent Publication No. 2003/0090174, published on May 15, 2003 to M. Ryder, describes a material transfer apparatus in which a tubular sleeve extends within a covering for accessing the material on the interior of the enclosure.

It is an object of the present invention to provide a method which allows a glove bag to be applied to high-temperature piping.

It is another object of the present invention to provide a method which avoids the release of asbestos during the installation of inspection ports.

It is another object of the present invention to provide a method which facilitates the ability to carry out positive material identification and ultrasonic inspection of pipe.

It is a further object of the present invention to provide a method for installing a re-enterable inspection port which allows for the installation with rope access and/or without scaffolding.

It is a further object of the present invention to provide a method for installing an inspection port which requires only a minimum of personnel.

It is a further object of the present invention to provide a method for installing an inspection, port which minimizes the requirements for the removal of asbestos from around the piping.

It is still another object of the present invention to provide a method for installing an inspection port which avoids shut down of the plant and process during the installation proceedings.

These and other objects and advantages of the present invention will become apparent from a reading of the attached specification and appended claims.

BRIEF SUMMARY OF THE INVENTION

The present invention is a method of installing an inspection port on a pipe having asbestos insulation extending therearound. The method of the present invention comprising the steps of: (1) positioning the inspection port within a glove bag; (2) affixing an opening of the glove bag onto a surface of the pipe; (3) removing a section of asbestos insulation from the pipe; (4) installing the inspection port onto the pipe within an area of the removed section; and (5) and removing the glove bag from the surface of the pipe.

In the method of present invention, the step of removing the section of asbestos material occurs entirely within the interior of the glove bag. The removed section of the asbestos insulation is placed within the interior of the glove bag. The interior of the glove bag is maintained at a pressure below ambient pressure.

In the present invention, radiant heat removal is accomplished by flowing air through an interior of the glove bag so as to lower a temperature within the glove bag.

The step of flowing air includes the steps of: (1) forming an air inlet port on the glove bag so as to communicate with the interior of the glove bag; (2) connecting a HEPA filter vacuum pump to the glove bag so as to communicate with the interior of the glove bag; and (3) operating the vacuum pump so as to draw air through the air inlet port. The air inlet port has a HEPA filter affixed thereto.

In the present invention, a water wash port can be formed on the glove bag. A water line can be connected into the interior of the glove bag through this water wash port. Water can be selectively passed from the water line into the interior of the glove bag.

At least one tool is positioned within the glove bag. The tool is manipulated within the glove bag so as to cut through the insulation covering and into the asbestos insulation. The glove bag has at least one glove extending thereinto. Subsequent to the removal of the section of asbestos insulation, the tool is stowed into the glove, the glove is then closed around the tool, and the glove and the tool are removed from the glove bag. The glove bag also has a collection bag therein. The removed section of heated asbestos insulation is stowed into this collection bag.

In the preferred embodiment of the present invention, a sheet of heat-resistant material is wrapped around at least a portion of the pipe. The step of affixing includes affixing the opening of the glove bag to a side of the sheet opposite the pipe. An inspection port hole is formed in the sheet with the perimeter edges sealed to the insulation outer covering. The inspection hole is positioned in a desired location on the pipe. The opening of the glove bag extends entirely around the inspection port hole.

The step of positioning the inspection port includes placing the inspection port within a closed bag, locating the closed bag in the glove bag, and then opening the closed bag after the section of asbestos insulation is removed. A lagging can be placed over the inspection port such that an opening of the lagging resides over the inspection port. The periphery of this lagging can then be banded around the pipe.

DETAILED DESCRIPTION OF THE INVENTION

Figure 1:
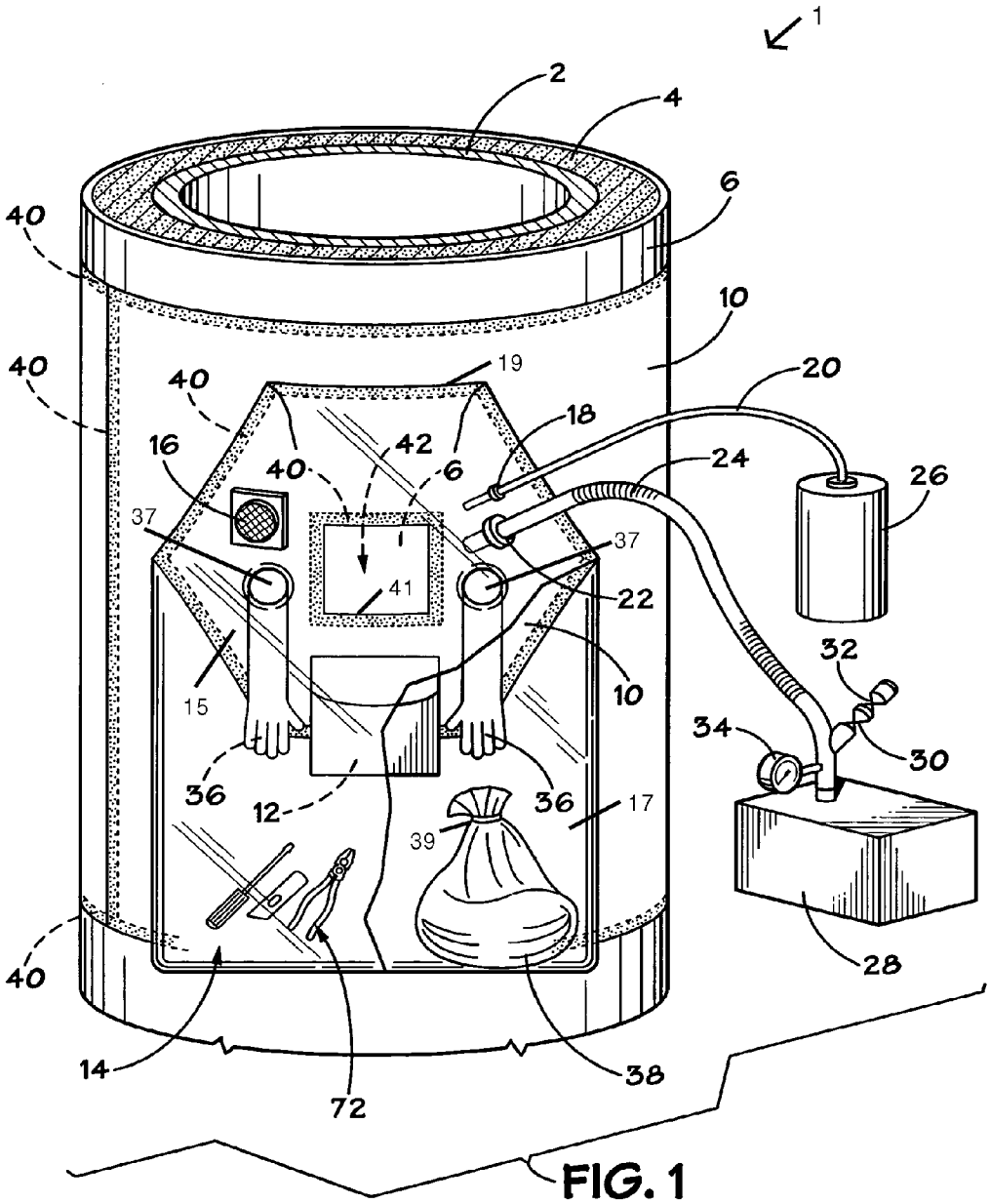
FIG. 1 is a perspective view of a preferred embodiment of the present invention prior to the removal of asbestos from the pipe.

Referring to FIG. 1, there is shown the piping system 1 associated with the method of the present invention. The piping system 1 includes a tubular interior pipe 2 that is surrounded by an asbestos insulation material 4. A lagging 6 surrounds the periphery of the insulation material so as to retain the insulation material 4 in direct proximity against an outer wall of the pipe 2. The pipe 2 is of a type that is used in process industries through which a fluid flows directly therethrough.

As can be seen in FIG. 1, a heat-resistant wrap 10 is placed around the outer surface of the insulation lagging 6. A sealing tape 40 is used to secure the wrap 10 around the lagging 6. As can be seen, the sealing tape 40 extends around the top edge and the bottom edge of the wrap 10. A section of tape 40 also extends vertically along a seam of the wrap 10.

In normal circumstances, it may not be necessary to use the heat-resistant wrap 10. It is preferred to use the heat resistant wrap 10 in those circumstances where hot spots develop upon the lagging 6. These hot spots can often occur by deterioration of the asbestos insulation 4 such that heat transferred from the pipe 2 will flow through the asbestos insulation 4 and into the metal lagging 6. If there are such "hot spots" which develop on the metal lagging 6, then it may be difficult to directly apply the glove bag 14 directly to the lagging 6. As such, the heat-resistant wrap 10 is initially applied around the periphery of the lagging 6. The wrap 10 can provide a surface onto which the glove bag 14 can be properly secured. The heat-resistant wrap 10 includes an opening 42 which will be located in a desired location for the installation of the inspection port.

The glove bag 14 has an opening 15 at one end thereof. The body 17 of the glove bag 14 will drape downwardly from the opening 15. The opening 15 has a periphery 19 which is secured by the use of sealing tape 40 to the surface of the wrap 10 (or directly onto the surface of the lagging 6). In particular, the opening 15 will extend around the opening 42 formed in the wrap 10. As a result, the opening 15 will be in a desired location for receiving removed insulation material from the area within the opening 42. The opening 42 has a perimeter 41 that is secured by sealing tape 40 to the wrap 10.

The glove bag 14 is configured so as to have a collection bag 12 secured thereto in an area directly below the opening 42. As a result, any material removed from the interior of the opening 42 can drop into the collection bag 12. The collection bag 12 has a portion that extends within the body 17 of the glove bag 14. Another portion of the collection bag 12 can be adhered to the wrap 10 directly below the opening 42.

In FIG. 1, it can be seen that the glove bag 14 has a pair of gloves 36 that have respective openings 37 opening to the exterior of the glove bag 14. As a result, when the user inserts his or her hands through the openings 37, they will reside within the glove 36 on the interior of the glove bag 14. The user can then manipulate his or her hands through the use of the gloves 36 so as to remove asbestos insulation 4 through the opening 42 and deposit the asbestos insulation 4 into the collection bag 12.

In the present invention, it can be seen that there is an air inlet port 16 mounted on a surface of the glove bag 14. A vacuum port 22 is also formed on a surface of the glove bag 14. Vacuum 28 has a hose 24 that extends therefrom and through the vacuum port 22 into the interior of the glove bag 14. The vacuum 28 has a gauge 34 mounted thereon and includes valves 30 and 32 which adjust the amount of vacuum produced by the vacuum 28 and the air flow through the interior of the glove bag 14. The gauge 34 will monitor the vacuum in the interior of glove bag 14. It should be noted that the air inlet port 16 has a HEPA filter mounted thereon so as to avoid the release of any asbestos particles in the event that the vacuum on the interior of the glove bag 14 is, in any way, compromised.

In the present invention, the vacuum 28 is configured so as to maintain the interior of the glove bag 14 in a generally negative pressure environment. More particularly, the pressure on the interior of the glove bag 14 should be below ambient pressure. As a result, particles will not flow outwardly of the glove bag 14 if the containment of the glove bag 14 is, in any way, damaged or impaired. Importantly, the flow of air through the air intake port 16 and outwardly through the hose 24 of vacuum 28 will create an effective temperature-reducing air flow through the interior of the glove bag 14. When the glove bag 14 is applied to high-temperature pipe 2, it may be necessary to dissipate the heat from the interior of the glove bag 14 during the removal of asbestos through the opening 42. This accomplished by drawing air through the bag, at a desired flow rate, so as to remove radiant heat from the interior of the bag. As a result, unlike prior art glove bags, the present invention can be effectively used in association with high-temperature piping. Additionally, the use of such air flows will tend to prevent any unintended melting of the material of the glove bag 14 or any potential injury to the person carrying out the asbestos removal by dissipating heat from the area of the glove bag 14. This is accomplished without any possibility of release of airborne asbestos from the glove bag 14.

In FIG. 1, it can be seen that the inspection port is received within the sealed bag 38 located in the body 17 of glove bag 14. A band 39 extends around the top of the bag 38 so as to effectively contain the inspection port therein. This is important since asbestos will be falling throughout the entirety of the body 17 during the asbestos removal process. So as to avoid contamination to the inspection port (to be installed in opening 42), the bag 38 is effectively sealed until such time as the asbestos is removed and the interior of the bag is suitably washed down. As a result, the present invention prevents contamination to the inspection port within the bag 38.

A plurality of tools 72 are also located in the body 17 of the glove bag 14. These tools 72 will be in a desired location that can be accessed by the user through the use of gloves 36. Tools 72 should be of a suitable type so as to allow for the removal of the asbestos 4 through the opening 42 by cutting, digging, or otherwise forming. The tools 72 should be also appropriate so as to facilitate the installation of the inspection port into the opening 42.

In the present invention, a water pump 26 is connected by water line 20 through a port 18 into the interior of the glove bag 14. The water pump 26 is configured so as to deliver water into the interior of the glove bag 14. The use of water can further wash particulate asbestos from the interior of the bag 14 and to clean desired surfaces within the bag 14.

Figure 2:
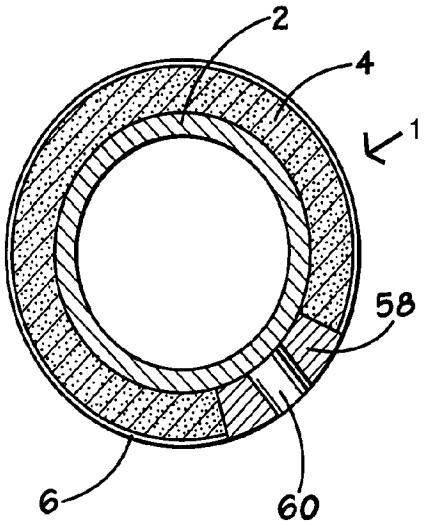
FIG. 2 is a plan view showing the inspection port as installed onto the pipe subsequent to the method of the present invention.

FIG. 2 is a cross-sectional view of the piping system 1 with the inspection port 58 installed on the piping system 1. In FIG. 2, it can be seen that the pipe 2 is located at the interior of the insulation 4. The lagging 6 extends around the insulation 4 on a side opposite the pipe 2. The inspection port 58 is installed so as to have a surface resting against the outer surface of the pipe 2 and side walls residing against the sides of the asbestos insulation 4. The exterior of the inspection port 58 will be flush with the outer surface of the lagging 6. In normal use, the sides and the perimeter of the inspection port 58 are suitably sealed to the lagging 6 or the insulation 4 so as to prevent any inadvertent release of asbestos from the area between the inspection port 58 and the asbestos 4. An opening 60 is located through the inspection port 58 so as to provide access to the outer diameter of the pipe 2. The opening 60 provides an area whereby ultrasonic inspection tools and/or positive material identification activities can take place.

Figure 3:
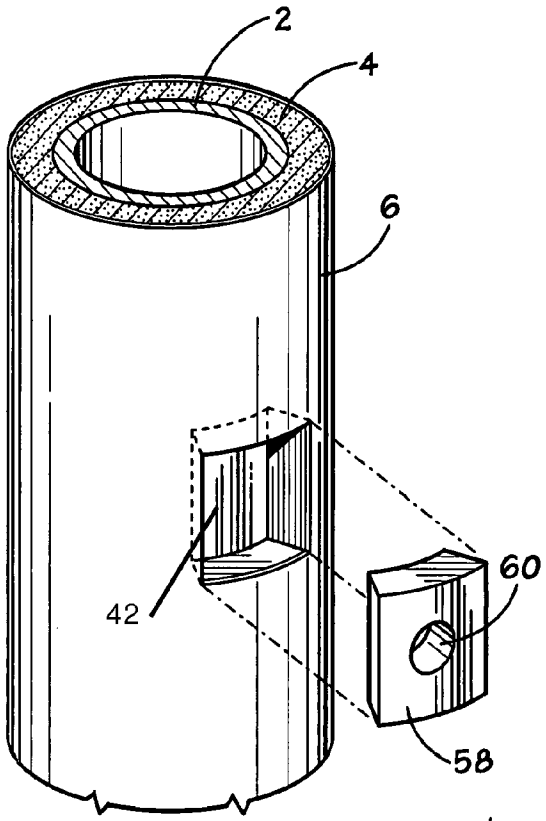
FIG. 3 is an exploded view showing the location of the inspection port relative to the pipe.

In FIG. 3, it can be seen that the opening 42 is formed through the lagging 6 and the asbestos insulation 4. The inspection port 58 is configured so as to fit within the area created by the removal of the asbestos. As can be seen, the sides of the inspection port 58 are suitably tapered inwardly. The opening 60 opens through the outer surface of the inspection port 58. The inspection port 58 is formed of a non-asbestos material.

Figure 4:
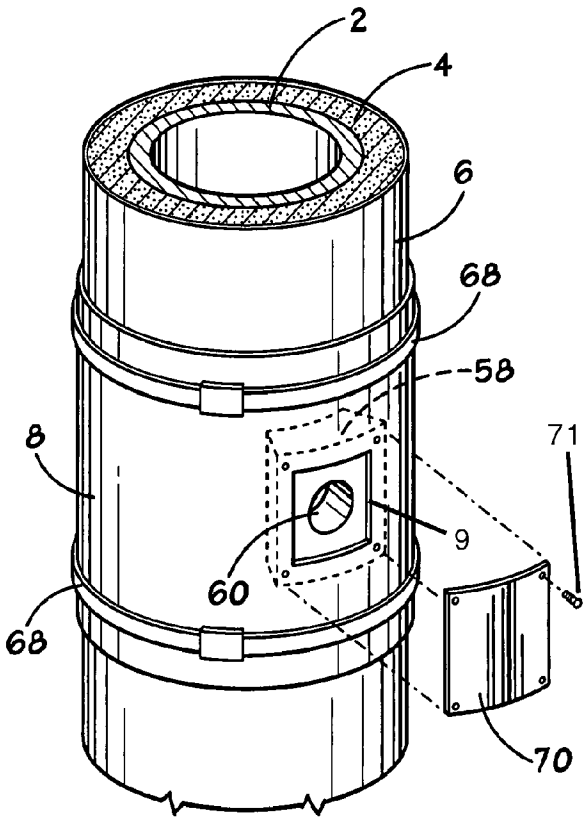
FIG. 4 is an exploded perspective view showing the inspection port as installed within the pipe insulation and a plate that is to be used to cover the inspection port.

In FIG. 4, it can be seen that the inspection port 58 has been suitably installed within the area of the removed asbestos. Once the inspection port has been installed and sealed around the periphery thereof, another lagging 8 can be wrapped around the existing lagging 6 so as to have an opening 9 that extends around the opening 60 of the inspection port 58. Bands 68 are placed around the sheet 8 so as to secure the sheet 8 in a desired position around the lagging 6. A cover plate 70 can be affixed by suitable screws 71 to the inspection port 58. As a result, the cover plate 70 can be removed, as required, so as to gain access to the opening 60 and the surface of the pipe 2. It should be noted that the cover plate 70 can also be formed of a clear material so that visual inspection of the opening 60 can easily occur. The use of the sheet 8, along with the band 68, further assures a secure asbestos containment area around the inspection port 58.

Figure 5:
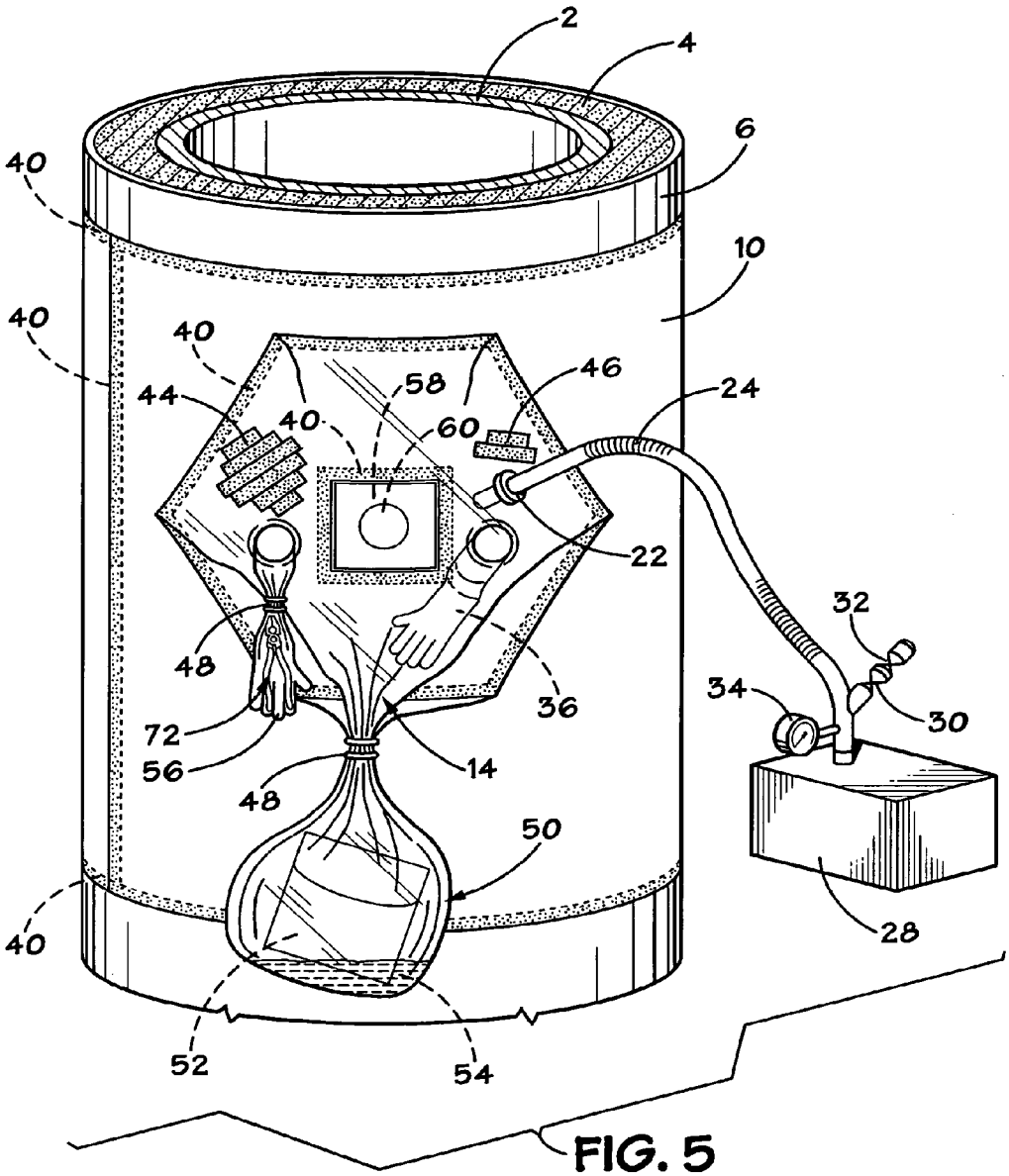
FIG. 5 is a perspective view of an intermediate step associated with the method of the present invention.

FIG. 5 shows how the inspection port 58 has been installed within the opening 42. Subsequent to this installation, the tools 72 are placed in glove 56. Bands 48 are then wrapped around the exterior of the glove 56 so as to effectively seal the tool 72 within the glove 56. The glove 56 can then be cut in the area between the bands 48 so as to separate the glove-covered tool 72 from the glove bag 14.

In FIG. 5, it can be seen that the detached collection bag 52 is received within the body at the lower end 50 of the glove bag 14. Water 54, along with entrapped asbestos, also resides at the bottom 50 of the glove bag 14. Bands 48 wrap around the exterior of the lower end 50 of glove bag 14. The asbestos, the lagging detached collection bag section 52 and the water 54 can be separated from the remainder of the glove bag 14 by simply cutting across the area between the bands 48.

Prior to the removal of the glove bag 14, tape is placed over the air intake port 44 and over the water port 46. As a result, any accidental release of asbestos through these ports is effectively prevented. The vacuum 28 will continue to run so as to draw the remaining air outwardly from the interior of the glove bag 14 and further to collapse the glove bag 14 against the surface of the wrap 10.

Figure 6:
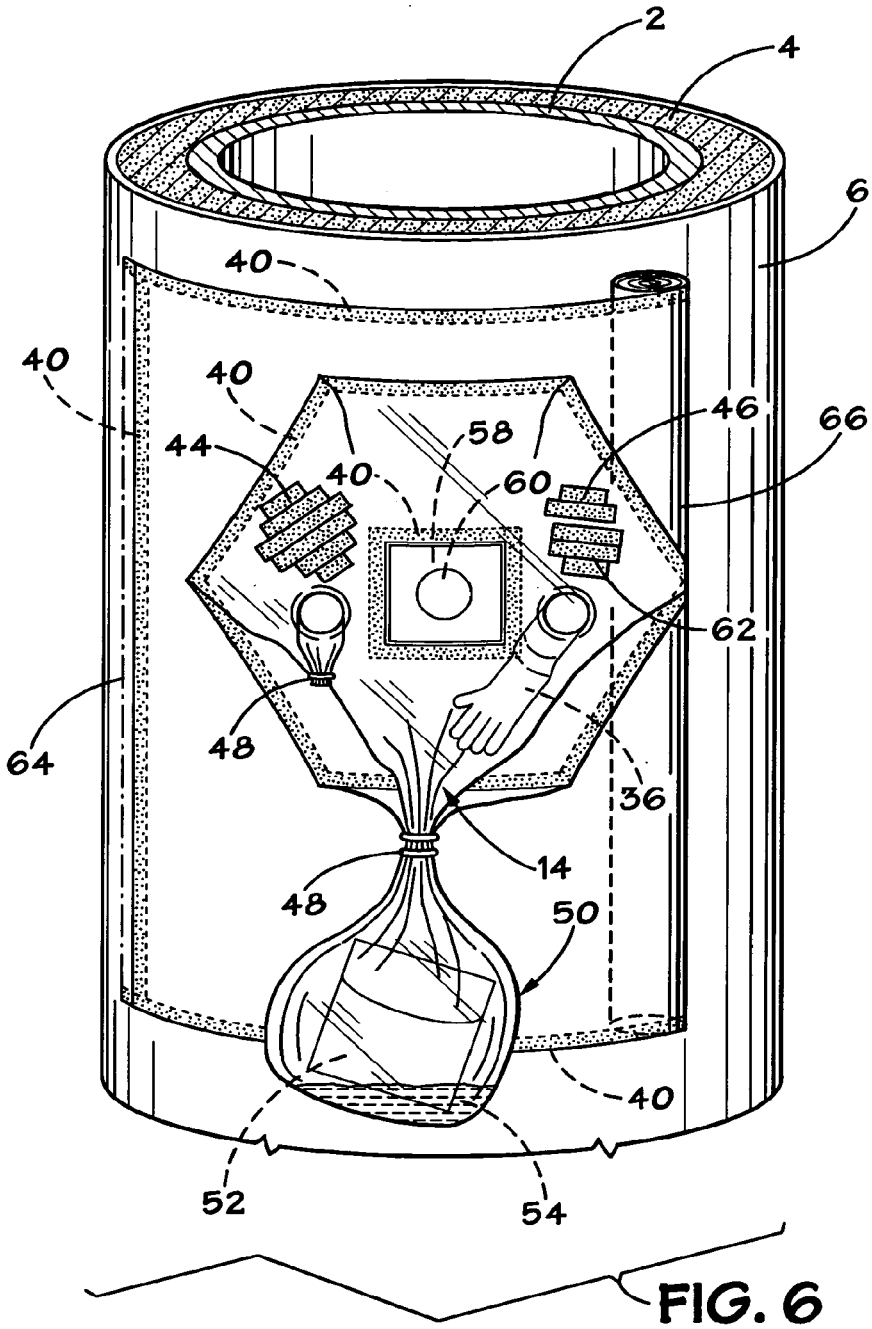
FIG. 6 is a perspective view showing a later step in the method of removing the glove bag.

FIG. 6 shows how the tool 72 has been removed from the remainder of the glove 56. Additionally, it can be seen that the wrap 10 is being rolled up from around the lagging 6. The vacuum hose 28 has been removed and the port 22 has been effectively closed by the use of tape 62. The rolled edge 66 is rolled in a particular manner so as to wrap below the opening of the glove bag 14. As a result, all asbestos contaminates will be securely retained and sealed within the interior of the glove bag 14. Subsequent to removal of the wrap 10, the inspection port 58 will be in desired location for installation of the sheet 8 and the bands 68.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A method of installing an inspection port structure onto a pipe having an asbestos insulation extending therearound, the method comprising:

positioning the inspection port structure within a glove bag;

wrapping a sheet of heat-resistant material around at least a portion of an outer surface of the asbestos insulation;

affixing an opening of said glove bag onto or adjacent to an outer surface of the asbestos insulation;

forming an inspection port hole in said sheet, said opening of said glove bag extending entirely around said inspection port hole;

flowing air through an interior of said glove bag so as to lower a temperature within said glove bag;

forming a section exposing the pipe by removing the asbestos insulation from such section;

installing the inspection port structure into the formed section; and removing said glove bag from said outer surface.

2. The method of claim 1, wherein the flowing of air comprises:

forming an air inlet port on said glove bag so as to communicate with said interior of said glove bag;

connecting a vacuum pump to said glove bag so as to communicate with said interior of said glove bag; and operating said vacuum pump so as to draw air through said air inlet port.

3. The method of claim 2, wherein the forming of an air inlet port comprises:

affixing a HEPA filter in said air inlet port.

4. The method of claim 1, further comprising:

forming a water wash port on said glove bag;

connecting a water line into an interior of said glove bag through said water wash port; and selectively passing water from said water line into said interior of said glove bag.

5. The method of claim 1, further comprising:

positioning at least one tool within said glove bag; and manipulating the tool within said glove bag so as to cut into the asbestos insulation.

6. The method of claim 5, said glove bag having at least one glove, the method further comprising:

stowing the tool into the glove;

closing the glove around tool; and removing the glove and the tool from the glove bag.

7. The method of claim 1, said glove bag having a collection bag therein, the method further comprising:

stowing the removed asbestos from the formed section into said collection bag.

8. A method of installing an inspection port structure onto a pipe having an asbestos insulation extending therearound, the method comprising:

positioning the inspection port structure within a glove bag;

affixing an opening of said glove bag onto or adjacent to an outer surface of the asbestos insulation;

flowing air through an interior of said glove bag so as to lower a temperature within said glove bag;

forming a section exposing the pipe by removing the asbestos insulation from said section;

installing the inspection port structure into the formed section by sealing a perimeter of said inspection port structure to a lagging extending around the outer surface of the asbestos insulation; and removing said glove bag from said outer surface.

9. A method of installing an inspection port structure onto a pipe having an asbestos insulation extending therearound, the method comprising:

positioning the inspection port structure within a glove bag;

affixing an opening of said glove bag onto or adjacent to an outer surface of the asbestos insulation;

flowing air through an interior of said glove bag so as to lower a temperature within said glove bag;

forming a section exposing the pipe by removing the asbestos insulation from said section;

installing the inspection port structure into the formed section;

removing said glove bag from said outer surface;

placing a sheet having an opening over said inspection port structure; and banding a periphery of said sheet to said pipe.

* * * * *